US007173574B2

(12) United States Patent
Koide

(10) Patent No.: US 7,173,574 B2
(45) Date of Patent: Feb. 6, 2007

(54) INTEGRATED ANTENNA AND METHOD OF MANUFACTURING THE SAME

(75) Inventor: Shirou Koide, Anjo (JP)

(73) Assignee: Denso Corporation, Kariya (JP)

( * ) Notice: Subject to any disclaimer, the term of this patent is extended or adjusted under 35 U.S.C. 154(b) by 19 days.

(21) Appl. No.: 11/186,070

(22) Filed: Jul. 21, 2005

(65) Prior Publication Data

US 2006/0017572 A1 Jan. 26, 2006

(30) Foreign Application Priority Data

Jul. 21, 2004 (JP) ..... 2004-212926

(51) Int. Cl.
*H01Q 1/12* (2006.01)

(52) U.S. Cl. ..... 343/878; 343/702

(58) Field of Classification Search ..... 343/878, 343/702, 700 MS, 729, 830
See application file for complete search history.

(56) References Cited

U.S. PATENT DOCUMENTS 5,262,795 A * 11/1993 DeMarre et al. ..... 343/829
6,211,830 B1 * 4/2001 Monma et al. ..... 343/702
6,295,030 B1 * 9/2001 Kozakai et al. ..... 343/700 MS
6,380,906 B1 * 4/2002 Cesulka ..... 343/773
6,452,558 B1 * 9/2002 Saitou et al. ..... 343/725
6,738,026 B1 * 5/2004 McKivergan et al. ..... 343/895
6,924,770 B2 * 8/2005 Carpenter et al. ..... 343/702
6,927,740 B2 * 8/2005 Sergi ..... 343/830

FOREIGN PATENT DOCUMENTS

JP 2002-111377 4/2002

* cited by examiner

*Primary Examiner*—Trinh Dinh
*Assistant Examiner*—Huedung Mancuso
(74) *Attorney, Agent, or Firm*—Harness, Dickey & Pierce, PLC

(57) ABSTRACT

In an integrated antenna, an antenna characteristic of a first antenna element is obtained when the first antenna element and a second antenna element are mounted on first and second positions of a base by first and second mount portions, respectively. A conductive dummy member has a shape detachably mountable on the second position by the second mount portion. The dummy member allows the first antenna element to substantially maintain the antenna characteristic when the first antenna element and the dummy member are mounted on the first and second positions of the base by the first and second mount portions, respectively.

8 Claims, 6 Drawing Sheets

FIG. 4

| f[MHz] | ASSY | DELETE | DUMMY (z=+1mm) | DUMMY (z=0mm) | DUMMY (z=-1mm) | DUMMY (z=-3mm) |
|---|---|---|---|---|---|---|
| 5785 | 5.9 | 4.6 | 6.9 | 6.7 | 6.6 | 5.9 |
| 5790 | 5.9 | 4.7 | 7.0 | 6.7 | 6.6 | 5.9 |
| 5795 | 6.2 | 5.0 | 7.2 | 6.9 | 6.8 | 6.1 |
| 5800 | 6.3 | 5.0 | 7.3 | 7.0 | 6.9 | 6.2 |
| 5805 | 6.3 | 5.0 | 7.1 | 6.8 | 6.8 | 6.1 |
| 5810 | 6.4 | 5.0 | 7.2 | 6.9 | 6.8 | 6.2 |
| 5815 | 6.3 | 5.0 | 7.0 | 6.7 | 6.7 | 6.0 |
| 5820 | 6.4 | 5.0 | 7.1 | 6.8 | 6.7 | 6.1 |
| 5825 | 6.1 | 4.8 | 7.0 | 6.8 | 6.6 | 5.9 |
| 5830 | 6.3 | 4.9 | 7.1 | 6.9 | 6.8 | 6.1 |
| 5835 | 6.4 | 5.0 | 7.3 | 7.1 | 6.9 | 6.1 |
| 5840 | 6.5 | 5.2 | 7.3 | 7.0 | 6.9 | 6.2 |
| 5845 | 6.7 | 5.3 | 7.5 | 7.2 | 7.0 | 6.4 |
| 5850 | 6.7 | 5.2 | 7.4 | 7.1 | 6.9 | 6.2 |
| 5855 | 6.8 | 5.2 | 7.5 | 7.1 | 7.0 | 6.3 |

INTEGRATED ANTENNA AND METHOD OF MANUFACTURING THE SAME

CROSS REFERENCE TO RELATED APPLICATION

This application is based on Japanese Patent Application 2004-212926 filed on Jul. 21, 2004. This application claims the benefit of priority from the Japanese Patent Application, so that the descriptions of which are all incorporated herein by reference.

FIELD OF THE INVENTION

The present invention relates to integrated antennas and methods of manufacturing integrated antennas. More particularly, the present invention relates to integrated antennas each allows a plurality of antenna elements to be installed, and to methods of manufacturing such integrated antennas.

BACKGROUND OF THE INVENTION

Integrated antennas each in which a plurality of antenna elements with different antenna characteristics are installed have been used; an example of which is disclosed in Japanese Patent Publication No. 2002-111377.

The antenna characteristics, such as gain and directivity, of each antenna element installed in such an integrated antenna depend on those of another antenna element installed therein. For this reason, with all of antenna elements installed in an integrated antenna, the antenna characteristics including the gain and directivity of each antenna element have been adjusted.

On the other hand, in order to increase functional variations, an integrated antenna can be shipped with at least one unnecessary antenna element removed from a state that all of antenna elements have been installed in the integrated antenna.

In the integrated antenna from which at least one unnecessary antenna element has been removed, the antenna characteristics including the gain and directivity of each antenna element are adjusted while all of the antenna elements are installed in the integrated antenna. Removal of at least one unnecessary antenna element from the integrated antenna may therefore cause the antenna characteristics of the remaining antenna elements to be changed. This may require readjustment of the antenna characteristics of the remaining antenna elements, causing both performance tests and man-hours required to manufacture the integrated antenna from which at least one unnecessary antenna element has been removed to increase.

SUMMARY OF THE INVENTION

The present invention is made on the background.

Accordingly, preferable embodiments of integrated antennas of the present invention are capable of eliminating the need to readjust the antenna characteristics of each antenna element installed in each of the integrated antennas. Preferable embodiments of integrated antenna manufacturing methods are capable of manufacturing the integrated antennas each capable of eliminating the readjustment necessity.

According to one aspect of the present invention, there is provided an integrated antenna allowing first and second conductive antenna elements to be installable. The integrated antenna includes a base, and a first mount portion disposed to the base and configured to mount the first antenna element on a first predetermined position of the base. The integrated antenna includes a second mount portion disposed to the base and configured to detachably mount the second antenna element on a second predetermined position of the base. An antenna characteristic of the first antenna element is obtained when the first and second antenna elements are mounted on the first and second predetermined positions of the base by the first and second mount portions, respectively. The integrated antenna includes a conductive dummy member with a shape detachably mountable on the second predetermined position by the second mount portion. The dummy member is configured to allow the first antenna element to substantially maintain the antenna characteristic when the first antenna element and the dummy member are mounted on the first and second predetermined positions of the base by the first and second mount portions, respectively.

According to one aspect of the present invention, there is provided a method of manufacturing an integrated antenna using a base, first and second conductive antenna elements. The first antenna element is mountable on a first predetermined position of the base, and the second antenna element is detachably mountable on a second predetermined position of the base. An antenna characteristic of the first antenna element is obtained when the first and second antenna elements are mounted on the first and second predetermined positions of the base, respectively. The method includes mounting the first and second antenna elements on the first and second predetermined positions of the base, respectively, when using both the first and second antenna elements. The method includes, when using the first antenna element without the second antenna element, preparing a conductive dummy member with a shape detachably mountable on the second predetermined position of the base. The dummy member is configured to allow the first antenna element to substantially maintain the antenna characteristic when the first antenna element and the dummy member are mounted on the first and second predetermined positions of the base, respectively. The method includes mounting the first antenna element and the dummy member on the first and second predetermined positions of the base, respectively.

BRIEF DESCRIPTION OF THE DRAWINGS

Other objects and aspects of the invention will become apparent from the following description of embodiments with reference to the accompanying drawings in which:

FIG. 4 is a table illustrating peaks of an ETC antenna's gain with respect to the radio waves every frequency within the range from 5785 MHz to 5855 MHz according to the embodiment;

DETAILED DESCRIPTION OF EMBODIMENTS OF THE INVENTION

An embodiment and its modifications of the present invention will be described hereinafter with reference to the accompanying drawings. In the embodiment, the invention is applied to an integrated antenna installed in, for example, a vehicle.

Figure 1A:
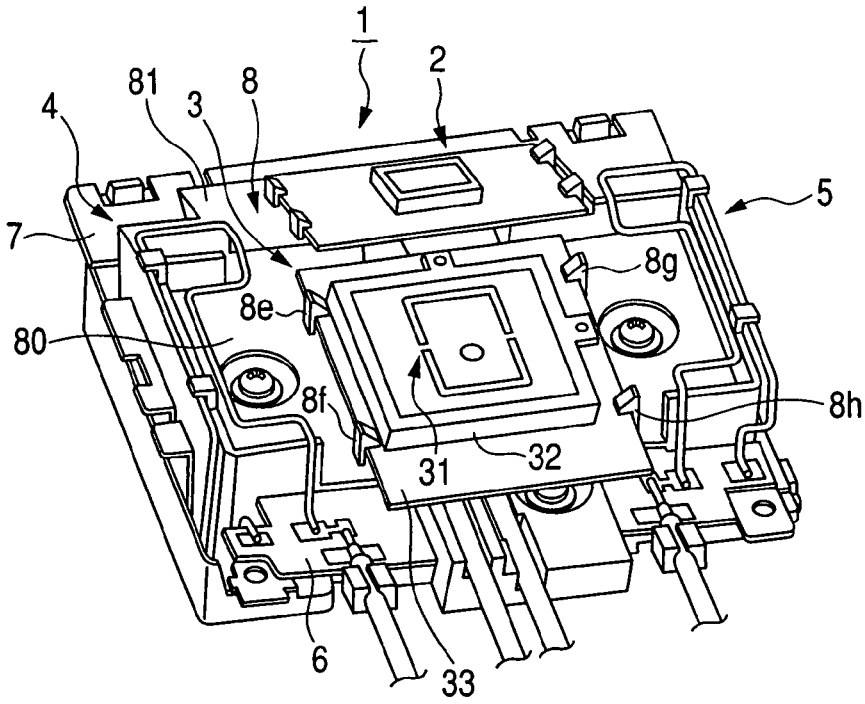
FIG. 1A is a perspective view schematically illustrating an example of the structure of an integrated antenna in which a GPS/VICS antenna element is installed according to an embodiment of the present invention.
Figure 2:
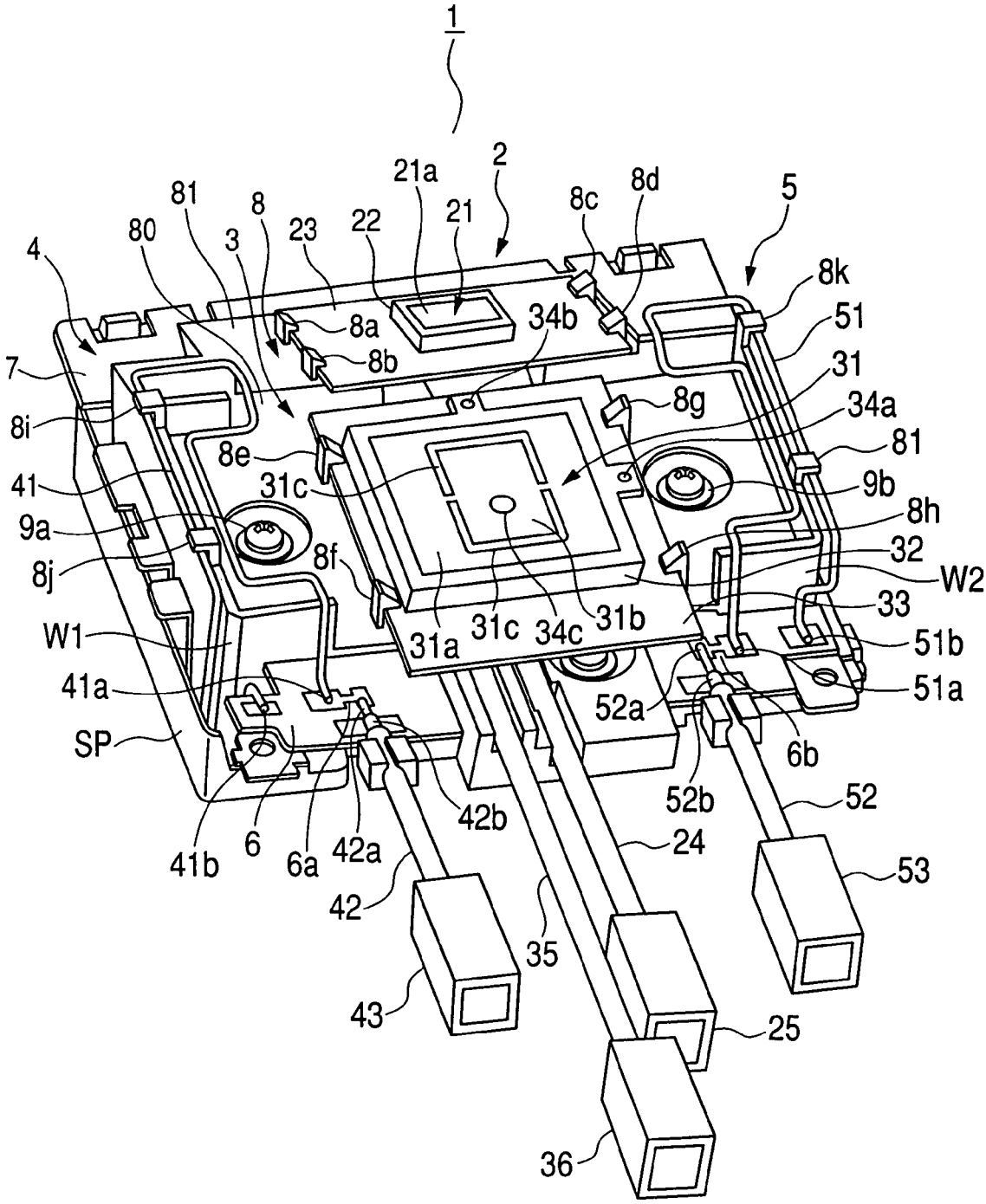
FIG. 2 is a perspective view schematically illustrating the overall structure of the integrated antenna in which the GPS/VICS antenna element is installed according to the embodiment of the present invention.

As illustrated in FIGS. 1A and 2, an in-vehicle integrated antenna 1 according to the embodiment is provided with a support portion SP. The support portion SP has an inner follow box shape with one bottom wall and one opened wall opposite thereto. The integrated antenna 1 is also provided with a ground plate 7 mounted on the peripheral end portion of the opened wall of the support portion SP such that, for example, the ground plate 7 is horizontally arranged. The integrated antenna 1 is further provided with a base 8 made of resin material and fixedly mounted on one surface of the ground plate 7 using screws 9*a* and 9*b*.

The integrated antenna 1 is also provided with an ETC (Electric Toll Collection) antenna element 2, GPS (Global Positioning System)/VICS (Vehicle Information Communication System) antenna element 3, and a pair of telephone antenna elements 4 and 5. The antenna elements 2 to 5 are mounted on the base 8 at predetermined positions thereof, respectively.

For example, the base 8 has a substantially rectangular shaped base portion 80 and an inclined portion 81 extending outwardly from one side of the base portion 80 to be inclined with respect to the ground plate 7 at a predetermined angle of substantially 23 degrees.

The ETC antenna element 2 is provided with a substantially rectangular shaped electrode plate 21 and a dielectric member 22 shaped as substantially rectangular-parallelepiped on which the electrode plate 21 is mounted. The ETC antenna element 2 is provided with an ETC circuit board 23 on which the dielectric member 22 is mounted. The ETC circuit board 23 is mounted on the inclined portion 81 so that four hook portions 8*a* to 8*d* formed on the inclined portion 81 engages the outer periphery of the ETC circuit board 23 to support it.

The ETC antenna element 2 is electrically connected to an ETC connector 25 through a coaxial cable 24, and the ETC connector 25 is electrically connected to an ETC radio device (not shown). These connections allow the ETC antenna element 2 to send/receive radio waves to/from the ETC radio device.

As set forth above, the ETC antenna element 2 is mounted on the inclined portion 81 of the base 8 such that the antenna surface 21*a* of the electrode plate 21 is inclined with respect to the ground plate 7 (horizontal surface direction) at substantially 23 degrees. This is because directions along which radio waves are transmitted from ETCs are inclined with respect to the vertical direction at substantially 23 degrees.

The GPS/VICS antenna element 3 is configured to provide commonality of GPS and VICS antenna elements. Specifically, the GPS/VICS antenna element 3 is provided with a substantially rectangular shaped electrode plate 31 and a dielectric member 32 shaped as substantially rectangular-parallelepiped on which the electrode plate 31 is mounted. The GPS/VICS antenna element 3 is provided with a ground plate 33 with one and the other surfaces. The dielectric member 32 is mounted on the one surface of the ground plate 33. A GPS/VICS circuit board (not shown) is disposed on the other surface side of the ground plate 33 to be mounted on the base portion 80 of the base 8. The outer periphery of the ground plate 33 is engaged with four hook portions 8*e* to 8*h* vertically formed on the base portion 80 to be detachably supported thereby.

The electrode plate 31 is provided with an inner electrode portion 31*b* with a substantially rectangular shape and an outer electrode portion 31*a* surrounding the inner electrode portion 31*b*. The electrode plate 31 is provided with a separate portion 31*c*, such as a space, by which the inner electrode portion 31*b* and the outer electrode portion 31*a* are substantially separated from each other. In the embodiment, the inner electrode portion 31*b* serves as a VICS electrode, and the outer electrode portion 31*a* serves as a GPS electrode.

In addition, the GPS/VICS antenna element 3 is provided with a pair of feeding points 34*a* and 34*b* that allows power to be fed to the GPS electrode 31*a*. The GPS/VICS antenna element 3 is also provided with a feeding point 34*c* that permits power to be fed to the VICS electrode 31*b*.

The feeding points 34*a* and 34*b* are electrically connected to a conductive trace formed on, for example, the GPS/VICS circuit board through an amplifier(s) and a band-pass filter installed thereon, and the feeding point 34*c* is electrically connected to the conductive trace through an amplifier(s) and a band-pass filter installed on the GPS/VICS circuit board. The conductive trace is electrically connected to a GPS/VICS connector 36 through a coaxial cable 35, and the GPS/VICS connector 36 is electrically connected to a GPS/VICS radio device (not shown). These connections allow the GPS/VICS antenna 3 to send/receive radio waves to/from the GPS/VICS radio device through the coaxial cable 35.

The GPS/VICS antenna element 3 is mounted on the base portion 81 of the base 8 such that the antenna surface of the electrode plate 31 is arranged substantially in parallel to the ground plate 7 (horizontal surface direction). This is because directions along which radio waves are transmitted from GPS systems and VICS systems are substantially parallel to the vertical direction.

The dielectric member 22 of the ETC antenna element 2 and the dielectric member 32 of the GPS/VICS antenna element 3 are configured to mechanically support the electrode plates 21 and 31, respectively. In addition, the dielectric member 22 allows wavelengths of radio waves therethrough to be shortened. Similarly, the dielectric member 32 allows wavelengths of radio waves therethrough to be shortened. The higher a dielectric constant of each of the dielectric members 22 and 32 is, the more the wavelengths of the radio waves transmitted through each of the dielectric members 22 and 32 are shortened. Employing a dielectric material with a high dielectric constant to form each of the dielectric members 22 and 32 permits the dielectric members 22 and 32 to be downsized, making it possible to reduce the whole size of the integrated antenna 1. Note that, as the dielectric materials for the dielectric members 22 and 32, resin whose base material is a material with low high-frequency loss, such as PPS (Polyphenylen Sulfide), ceramic or the like can be used.

The telephone antenna element 4 serves as a telephone main antenna element. Specifically, the telephone antenna element 4 is provided with a line conductive member (transmission line component) 41 designed to, for example, a modified-folded antenna with a predetermined modified and folded shape. On one side adjacent to the inclined portion side of the base portion 80, a first support wall W1 is vertically arranged. The modified and folded line conductive member 41 is supported to the first support wall W1 by a pair of hook portions 8*i* and 8*j* attached to the first support wall W1.

One end 41*a* of the line conductive member 41 is connected to a conductive lead path 6*a* formed on one end of a telephone circuit board 6 mounted along one side of the base wall of the support portion SP, which is opposite to the inclined portion 81 of the base 8. The conductive lead path 6*a* is electrically connected to an inner conductor 42*a* of a coaxial cable 42 so that power can be fed through the inner conductor 42*a* to the line conductive member 41. Incidentally, an outer conductor 42*b* is connected through the telephone circuit board 6 to be grounded.

The other end 41*b* of the line conductive member 41 is connected through the telephone circuit board 6 to be grounded. One end of a first telephone connector 43 is connected to the coaxial cable 42, and the other end thereof is connected to a telephone radio device (not shown). These connections allow the line conductive member 41 to send/receive radio waves to/from the telephone radio device.

The line conductive member 41 is routed not only above the one surface of the ground plate 7 but also through the inner follow portion of the support portion SP below the other surface of the ground plate 7. The total length of the line conductive antenna 41 is set to substantially one-half of a predetermined target wavelength of the line conductive antenna 41, serving as a modified-folded dipole antenna.

The telephone antenna element 5 serves as a telephone sub-antenna element Specifically, the telephone antenna element 5 is provided with a line conductive member (transmission line component) 51 designed to, for example, a modified-folded antenna with a predetermined modified and folded shape like the telephone antenna element 4. On the other side adjacent to the inclined portion side of the base portion 80, a second support wall W2 is vertically arranged. The modified and folded line conductive member 51 is supported to the second support wall W2 by a pair of hook portions 8*k* and 8*l* attached to the second support wall W2.

One end 51*a* of the line conductive member 51 is connected to a conductive lead path 6*b* formed on the other end of the telephone circuit board 6. The conductive lead path 6*b* is electrically connected to an inner conductor 52*a* of a coaxial cable 52 so that power can be fed through the inner conductor 52*a* to the line conductive member 51. Incidentally, an outer conductor 52*b* is connected through the telephone circuit board 6 to be grounded.

The other end 51*b* of the line conductive member 51 is connected through the telephone circuit board 6 to be grounded. One end of a second telephone connector 53 is connected to the coaxial cable 52, and the other end thereof is connected to the telephone radio device. These connections allow the line conductive member 51 to send/receive radio waves to/from the telephone radio device.

The line conductive member 51 is routed only above the one surface of the ground plate 7. The total length of the line conductive antenna 51 is set to substantially one-quarter of a predetermined target wavelength of the line conductive antenna 51, serving as a modified-folded monopole antenna.

The pair of telephone antenna elements 4 and 5 allows the integrated antenna 1 to obtain diversity effect.

The ground plate 7 serves as a ground of each of the ETC antenna element 2, the GPS/VICS antenna element 3, and the pair of telephone antenna element 4 and telephone antenna element 5.

Next, the antenna characteristics of each of the ETC antenna element 2, the GPS/VICS antenna element 3, and the pair of telephone antenna elements 4 and 5 will be described hereinafter. As illustrated in FIG. 2, in order to make the whole size of the integrated antenna 1 compact, these antenna elements 2 to 5 are closely arranged to each other on the base 8, in other words, densely packed thereon.

This causes the antenna characteristics of each of the antenna elements 2 to 5 to depend on another antenna element. For this reason, with all of the antenna elements 2 to 5 mounted on the base 8 of the integrated antenna 1, the antenna characteristics including, for example, gain and directivity of each antenna element have been adjusted in consideration of the position and the shape of another antenna element to obtain desirable antenna characteristics.

Next, a dummy member related to the embodiment of the present invention will be described hereinafter with reference to FIG. 1B, FIGS. 3A and 3B.

Specifically, in the embodiment, a dummy member 10 for the GPS/VICS antenna element 3 will be described hereinafter. Note that, in the descriptions hereinafter, a first antenna element related to the present invention corresponds to, for example, at least one of the ETC antenna element 2, the telephone antenna element 4, and the telephone antenna element 5. A second antenna element related to the present invention corresponds to, for example, the GPS/VICS antenna element 3.

Figure 3A:
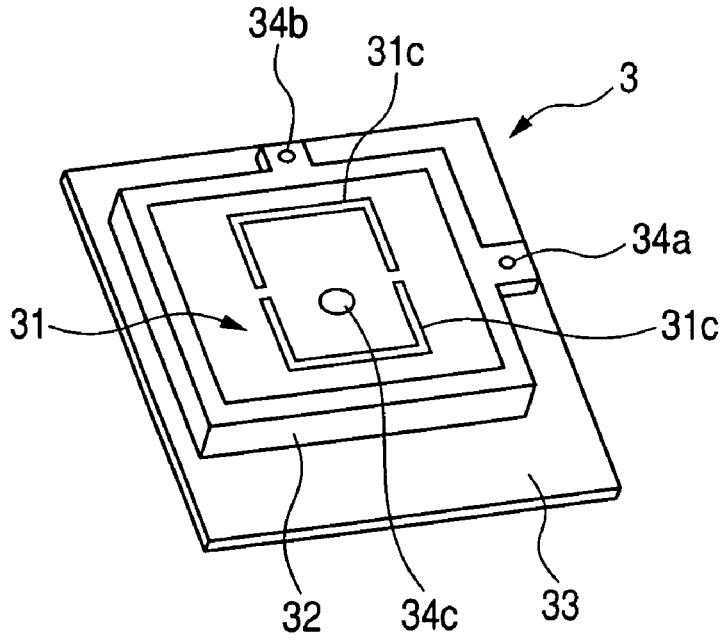
FIG. 3A is a perspective view schematically illustrating the GPS/VICS antenna element illustrated in FIG. 2 according to the embodiment.
Figure 3B:
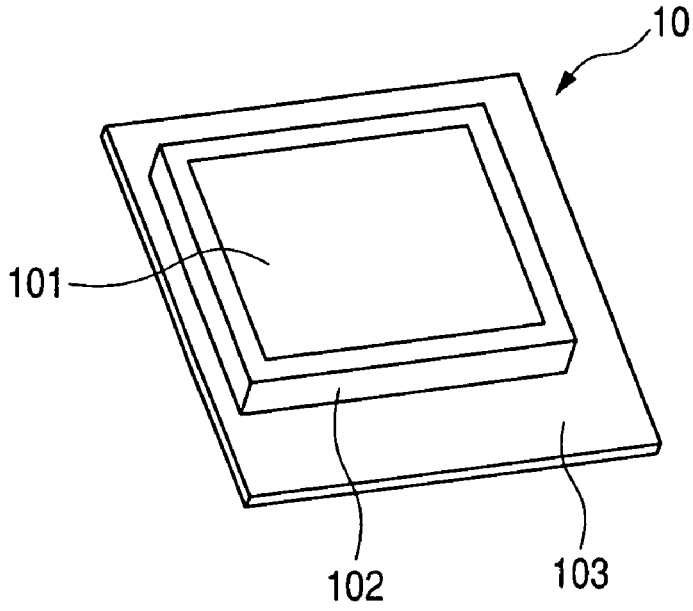
FIG. 3B is a perspective view schematically illustrating the dummy member illustrated in FIG. 1B according to the embodiment.

As illustrated in FIG. 3B as compared with FIG. 3A, the dummy member 10 is provided with an electrode plate 101 made of substantially the same material as the electrode plate 31 and having substantially the same shape and size as the electrode plate 31. The dummy member 10 is also provided with a dielectric member 102 made of substantially the same material as the dielectric member 32 and having substantially the same shape and size as the dielectric member 32. The electric plate 101 is mounted on the dielectric member 102 at a predetermined position thereof, which is substantially similar to the arrangement of the electrode plate 31 to the dielectric member 32.

In addition, the dummy member 10 is provided with a ground plate 103 made of substantially the same material as the ground plate 33 and having substantially the same shape and size as the ground plate 33. The dielectric member 102 is mounted on one surface of the ground plate 103 at a predetermined position thereof, which is substantially similar to the arrangement of the dielectric member 32 to the ground plate 33. Specifically, orientation of the dummy member 10 mounted on the predetermined position of the base portion 80 of the base 8 is substantially the same as that of the GPS/VICS antenna element 3 when it is mounted on the predetermined position of the base portion 80 of the base 8.

The dummy member 10 has no separate portion corresponding to the separate portion 31*c* of the antenna element 3 so that inner and outer electrode portions corresponding to the inner and outer electrode portions 31*a* and 31*b* of the antenna element 3 are not clearly formed in the dummy member. In addition, the dummy member 10 has no feeding points corresponding to the feeding points 34*a* to 34*c* of the antenna element 3 so that, for example, it is difficult to feed power to the dummy member 10.

That is, because of the structure of the dummy member 10 without having separated electrode portions, separate portion, and feeding points, it is possible to simply manufacture the dummy member 10 with low cost, as compared with manufacturing the antenna element 3.

Figure 1B:
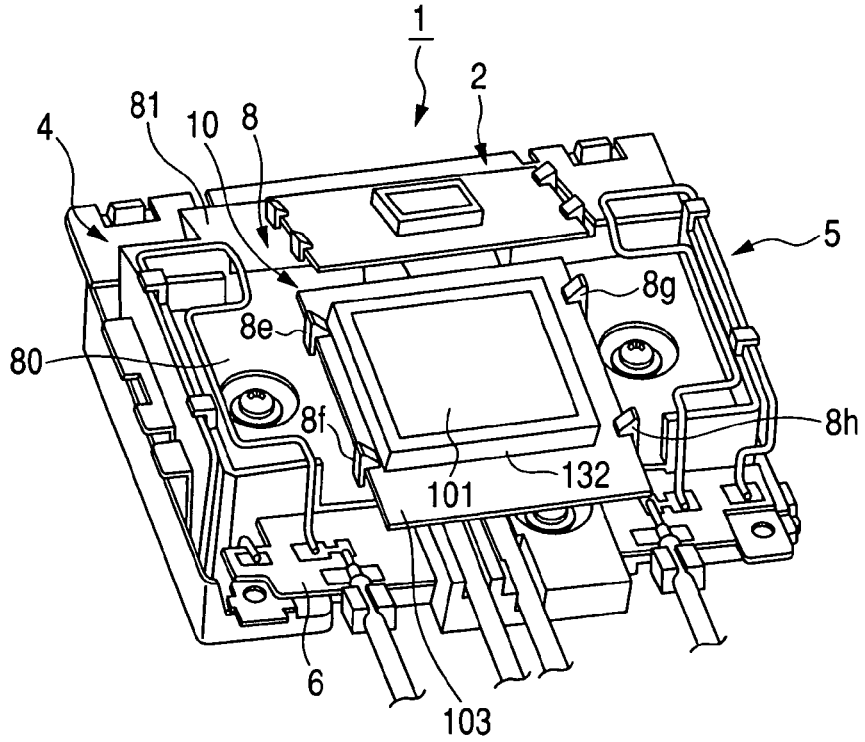
FIG. 1B is a perspective view schematically illustrating the structure of the integrated antenna in which a dummy member is installed in place of the GPS/VICS antenna element according to the embodiment of the present invention.

In addition, as illustrated in FIG. 1B, after replacement of the antenna element 3 from the base 8, the dummy member 10 can be mounted on the base portion 80 of the base 8 such that the outer periphery of the ground plate 103 is supported by the four hook portions 8*e* to 8*h*. The mount position of the dummy member 10 on the base portion 80 of the base is substantially the same as that of the antenna element 3 on the base portion 80 thereof.

Specifically, in the embodiment, the dummy member 10 has substantially the same shape and size as the antenna element 3, and the mount position of the dummy member 10 to the base 8 is substantially the same as that of the antenna element 3 to the base 8. For this reason, the dummy member 10 has an influence on the antenna characteristics of each of the antenna elements 2, 4, and 5; this influence is substantially the same as an influence of the GPS/VICS antenna element 3 on the antenna characteristics of each of the antenna elements 2, 4, and 5.

When assembling the integrated antenna 1 therefore, if all of the ETC antenna element 2, the GPS/VICS antenna element 3, and the pair of telephone antenna elements 4 and 5 are needed to be mounted on the base 8, these antenna elements 2 to 5 can be mounted on the base 8, respectively (see FIG. 1A).

In contrast, if the ETC antenna element 2, and the pair of telephone antenna elements 4 and 5 are only needed to be mounted on the base 8, but the GPS/VICS antenna element 3 is not, the antenna element 2, 4, and 5, and the dummy member 10 can be mounted on the base 8.

The integrated antenna 1 with the dummy member 10 in place of the GPS/VICS antenna element 3 can maintain substantially constant the antenna characteristics of each of the ETC antenna element 2, and the telephone antenna elements 4 and 5. This is because the dummy member 10 has an influence on the antenna characteristics of each of the antenna elements 2, 4, and 5; this influence is substantially the same as an influence of the GPS/VICS antenna element 3 on the antenna characteristics of each of the antenna elements 2, 4, and 5.

Even if the GPS/VICS antenna element 3 is replaced to the dummy member 10 therefore, there can be no need to readjust the antenna characteristics of each of the antenna elements 2, 4, and 5.

In order to bear out the effects set forth above, the inventors of the invention have measured the changes of the ETC antenna element's gain as representation of an influence of the dummy member 10, which has been mounted on the base 8 in place of the antenna element 3, on the ETC antenna element 2.

FIGS. 4 to 6 represent the results of the measurements of the ETC antenna element's gain with respect to the range of frequency f of radio waves between 5785 MHz and 5855 MHz; this frequency band is used for the ETC systems.

Note that, in FIGS. 4 to 6, the reference character "ASSY" represents the results of the measurements of the ETC antenna element's gain in a first case where the GPS/VICS antenna element is accurately mounted on the predetermined position of the base portion 80 of the base 8. In FIGS. 4 to 6, note that the reference character "DELETE" represents the result of the measurement of the ETC antenna element's gain in a second case where the GPS/VICS antenna element 3 is replaced from the base portion 80 of the base 8. In other words, in the second case, no antenna element is mounted on the predetermined position of the base portion 80 of the base 8.

In FIGS. 4 to 6, note that the reference characters "DUMMY (z=+1 mm)" represents the result of the measurement of the ETC antenna element's gain in a third case where the dummy member 10 is mounted on a position which is 1 mm higher along the vertical direction than the predetermined position of the base portion 80 of the base 8. In FIGS. 4 to 6, note that the reference characters "DUMMY (z=0 mm)" represents the result of the measurement of the ETC antenna element's gain in a fourth case where the dummy member 10 is accurately mounted on the predetermined position of the base portion 80 of the base 8.

In FIGS. 4 to 6, note that the reference characters "DUMMY MEMBER (z=−1 mm)" represents the result of the measurement of the ETC antenna element's gain in a fifth case where the dummy member 10 is mounted on a position which is 1 mm lower along the vertical direction than the predetermined position of the base portion 80 of the base 8. In FIGS. 4 to 6, note that reference characters "DUMMY (z=−3 mm)" represents the result of the measurement of the ETC antenna element's gain in a sixth case where the dummy member 10 is mounted on a position which is 3 mm lower along the vertical direction than the predetermined position of the base portion 80 of the base 8.

Figure 5A:
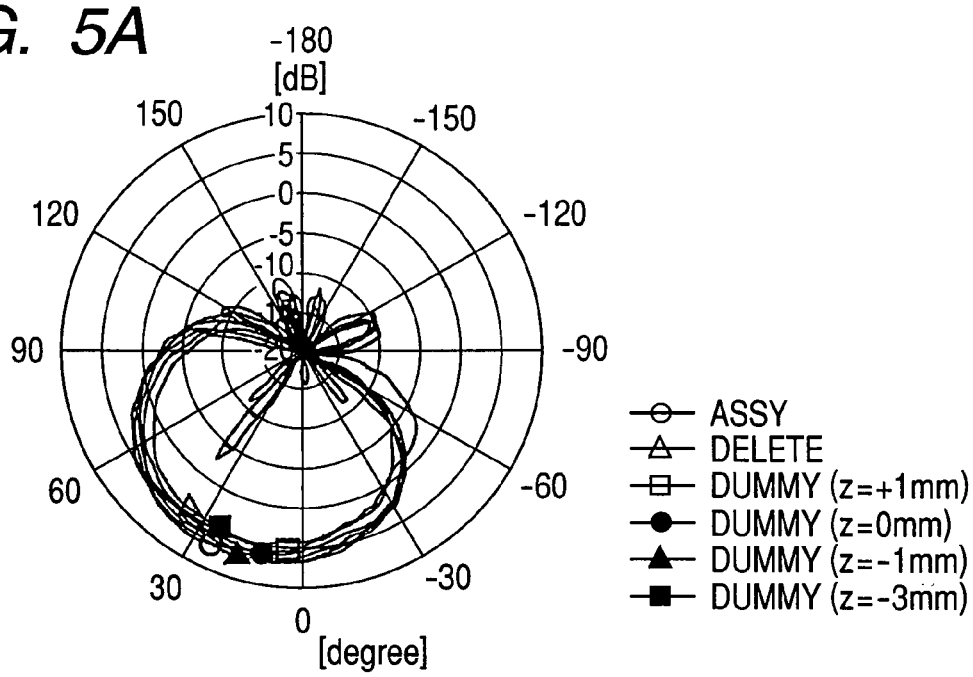
FIG. 5A is a graph illustrating vertical directivity patterns of an ETC antenna element, which have been obtained in first to sixth cases, described hereinafter, with respect to radio waves whose frequency band is set to substantially 5820 MHz according to the embodiment.
Figure 5B:
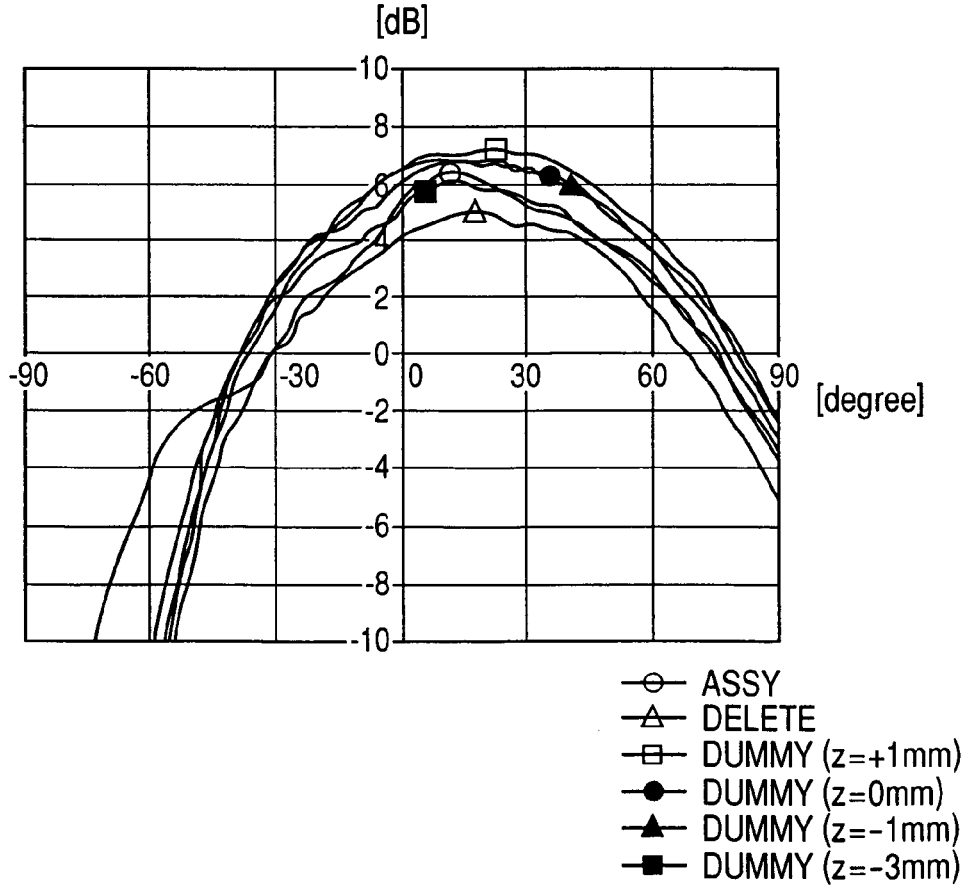
FIG. 5B is a graph illustrating the peak of the ETC antenna's gain with respect to the radio waves whose frequency band is set to substantially 5820 MHz according to the embodiment.

Specifically, FIG. 5A represents vertical directivity patterns of the ETC antenna element 2, which have been obtained in the first to sixth cases with respect to the radio waves whose frequency band is set to substantially 5820 MHz. FIG. 5B represents the peak of the ETC antenna's gain with respect to the radio waves whose frequency band is set to substantially 5820 MHz.

Figure 6A:
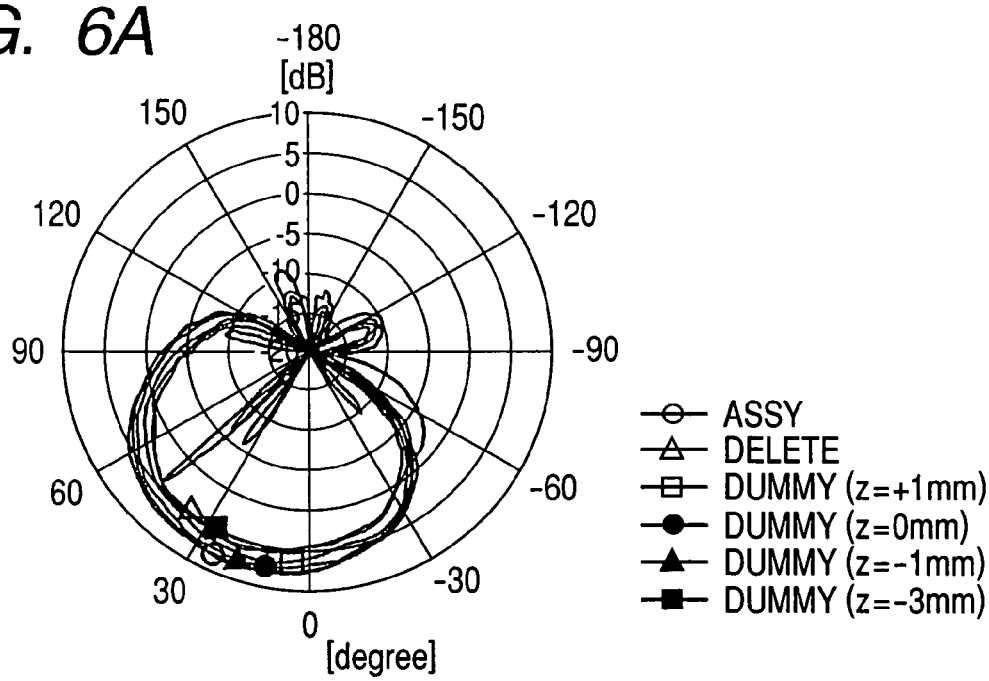
FIG. 6A is a graph illustrating vertical directivity patterns of an ETC antenna element, which have been obtained in first to sixth cases with respect to radio waves whose frequency band is set to substantially 5820 MHz according to the embodiment.
Figure 6B:
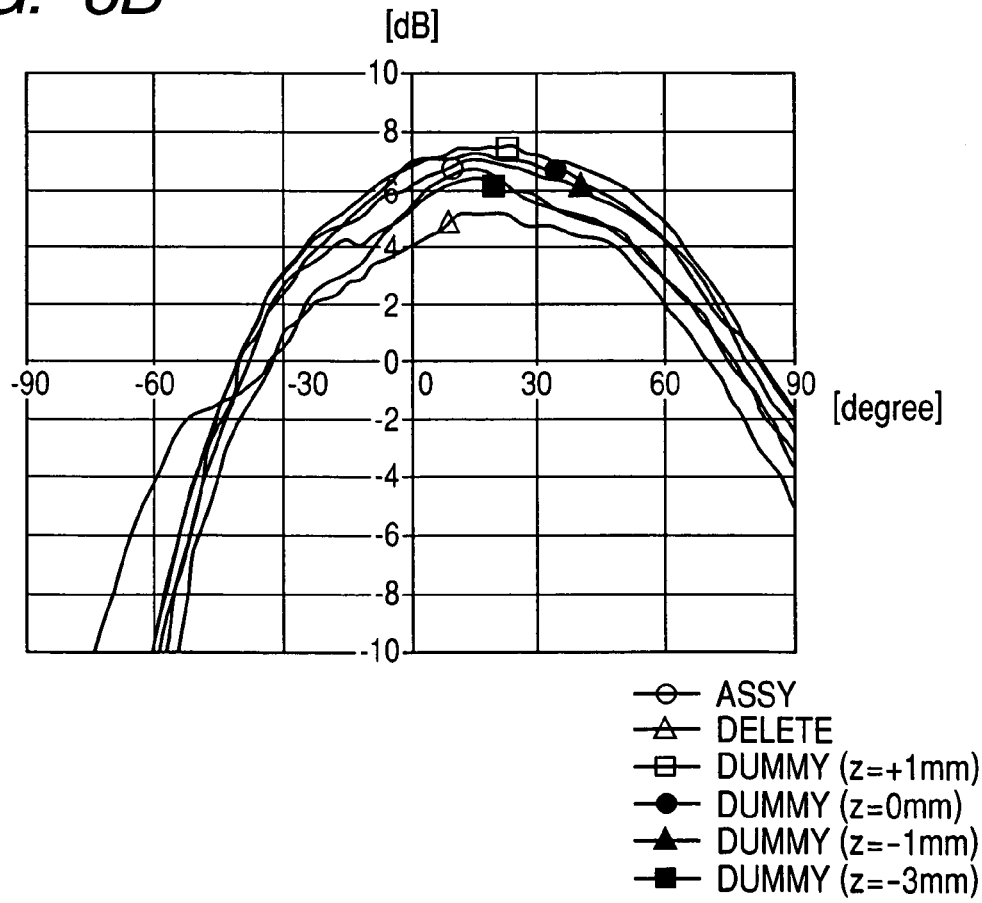
FIG. 6B is a graph illustrating the peak of the ETC antenna's gain with respect to the radio waves whose frequency band is set to substantially 5845 MHz according to the embodiment.

In addition, FIG. 6A represents vertical directivity patterns of the ETC antenna element 2, which have been obtained in the first to sixth cases with respect to the radio waves whose frequency band is set to substantially 5845 MHz. FIG. 6B represents the peak of the ETC antenna's gain with respect to the radio waves whose frequency band is set to substantially 5845 MHz. Incidentally, all dimensions in FIG. 4 without the dimension "MHz" of the frequency f of the radio waves is "dB".

As clearly illustrated in FIGS. 4 to 6, when the integrated antenna from which the GPS/VICS antenna element 3 is replaced corresponding to the second case, the peak of the ETC antenna's gain with respect to the radio waves whose frequency range from 5785 MHz to 5855 MHz decreases as compared with the integrated antenna to which the antenna element 3 is accurately mounted on the predetermined position of the base 8 corresponding to the first case.

In contrast, when the integrated antenna to which the dummy member 10 is mounted within ±1 mm along the vertical direction with respect to the predetermined position of the base 8 corresponding to the third to fifth cases, the peak of the ETC antenna's gain with respect to the radio waves whose frequency range from 5785 MHz to 5855 MHz is substantially the same as that of the integrated antenna to which the antenna element 3 is accurately mounted on the predetermined position of the base 8 corresponding to the first case.

In addition, when the integrated antenna to which the dummy member 10 is mounted beyond ±1 mm along the vertical direction with respect to the predetermined position of the base 8 corresponding to the sixth case, the peak of the ETC antenna's gain with respect to the radio waves whose frequency range from 5785 MHz to 5855 MHz decreases as compared with the integrated antenna to which the antenna element 3 is accurately mounted on the predetermined position of the base 8 corresponding to the first case.

Moreover, as clearly understood in FIGS. 5A and 6A, the vertical directivity patterns of the ETC antenna 2 when the dummy member 10 is mounted on the base 8 in place of the antenna element 3 are substantially the same as those of the ETC antenna 2 when the antenna element 3 is mounted on the base 8.

As described above, in the embodiment of the present invention, even if the antenna element 3 is replaced from the predetermined position of the base 8, mount of the dummy member 10 on the predetermined position of the base 8 allows the antenna characteristics of the ETC antenna element 2 to be substantially kept constant.

In the embodiment, the dummy member 10 corresponding to the GPS/VICS antenna element 3 is prepared to be mounted on the base 8. In the present invention, however, a dummy member corresponding at least one of the ETC antenna element 2, the telephone antenna element 4, and the telephone antenna element 5 can be prepared to be detachably mounted on the base 8 in place of at least one of the antenna elements 2, 4, and 3.

For example, when a dummy member corresponding to the ETC antenna element 2 is prepared, the dummy member is provided with an electrode plate made of substantially the same material as the electrode plate 21 and having substantially the same shape and size as the electrode plate 21. The dummy member is also provided with a dielectric member made of substantially the same material as the dielectric member 22 and having substantially the same shape and size as the dielectric member 22. The electric plate of the dummy member is mounted on the dielectric member thereof at a predetermined position thereof, which is substantially similar to the arrangement of the electrode plate 21 to the dielectric member 22. The dielectric member of the dummy member is mounted on the ETC circuit board 23 at a predetermined position thereof, which is substantially similar to the arrangement of the dielectric member 22 to the ETC circuit board 23.

As set forth above, in the embodiment of the present invention, even if the ETC antenna 2, and the telephone antennas 4 and 5 are mounted on the base 8, and the dummy member 10 is mounted thereon in place of the GPS/VICS antenna element 3, it is possible to obtain the antenna characteristics of each of the antenna elements 2, 4, and 5; these antenna characteristics are substantially the same as those obtained when all of the antenna elements 2 to 5 are mounted on the base 8.

This allows the antenna characteristics of each of the antenna elements 2, 4, and 5 to be kept constant independently of existence or nonexistence of the antenna element 3. There can be therefore no need to readjust the antenna characteristics of each of the antenna elements 2, 4, and 5 based on existence or nonexistence of the antenna element 3. This makes it possible to prevent performance tests and man-hours required to assemble the integrated antenna 1 without using the GPS/VICS antenna element 3 from increasing and to address removal of the GPS/VICS antenna element 3 from the integrated antenna 1 and/or remount thereof on the integrated antenna 1.

In the embodiment, the present invention is applied to the in-vehicle integrated antenna 1 installed in a vehicle, but can be applied to indoor integrated antennas each disposed in a room and/or to outdoor integrated antennas each disposed out of a room. The number of antenna elements mounted on the base of the integrated antenna and the configuration of each of the antennal elements can be changed within the spirit and scope of the present invention.

In the embodiment, the shapes and the sizes of the components 101 to 103 of the dummy member 10 are substantially the same as those of the components 31 to 33 of the antenna element 3, but the present invention is not limited to the structure. Specifically, the shapes and the sizes of the components 101 to 103 of the dummy member 10 can be changed to those of the components 31 to 33 of the antenna element 3 as long as the antenna characteristics of each of the antenna elements 2, 4, and 5 of the integrated antenna using the dummy member are substantially the same as those of each of the antenna elements 2, 4, and 5 of the integrated antenna using the antenna element 3.

While there has been described what is at present considered to be these embodiments and modifications of the present invention, it will be understood that various modifications which are not described yet may be made therein, and it is intended to cover in the appended claims all such modifications as fall within the true spirit and scope of the invention.

What is claimed is:

1. An integrated antenna allowing first and second conductive antenna elements to be installable, the integrated antenna comprising:

a base;

a first mount portion disposed to the base and configured to mount the first antenna element on a first predetermined position of the base;

a second mount portion disposed to the base and configured to detachably mount the second antenna element on a second predetermined position of the base, an antenna characteristic of the first antenna element being obtained when the first and second antenna elements are mounted on the first and second predetermined positions of the base by the first and second mount portions, respectively; and a conductive dummy member with a shape detachably mountable on the second predetermined position by the second mount portion, the dummy member being configured to allow the first antenna element to substantially maintain the antenna characteristic when the first antenna element and the dummy member are mounted on the first and second predetermined positions of the base by the first and second mount portions, respectively.

2. An integrated antenna according to claim 1, wherein the dummy member has a predetermined size, and the shape and the size of the dummy member being substantially the same as those of the second antenna element.

3. An integrated antenna according to claim 1, wherein the second antenna element is provided with a first electrode member with a feeding point, and the dummy member is provided with a second electrode member having substantially the same shape and size as those of the first electrode member, the second electrode member having no feeding points.

4. An integrated antenna according to claim 1, wherein the dummy member is mounted on the second predetermined position of the base by the second mount portion, and orientation of the dummy member mounted on the second predetermined position is substantially the same as that of the second antenna element when the second antenna element is mounted on the second predetermined position of the base by the second mount portion.

5. A method of manufacturing an integrated antenna using a base, first and second conductive antenna elements, in which the first antenna element is mountable on a first predetermined position of the base, the second antenna element is detachably mountable on a second predetermined position of the base, and an antenna characteristic of the first antenna element is obtained when the first and second antenna elements are mounted on the first and second predetermined positions of the base, respectively, the method comprising:

mounting the first and second antenna elements on the first and second predetermined positions of the base, respectively, when using both the first and second antenna elements;

when using the first antenna element without the second antenna element, preparing a conductive dummy member with a shape detachably mountable on the second predetermined position of the base, the dummy member being configured to allow the first antenna element to substantially maintain the antenna characteristic when the first antenna element and the dummy member are mounted on the first and second predetermined positions of the base, respectively; and mounting the first antenna element and the dummy member on the first and second predetermined positions of the base, respectively.

6. A method of manufacturing an integrated antenna according to claim 5, wherein the dummy member has a predetermined size, and the shape and the size of the dummy member being substantially the same as those of the second antenna element.

7. A method of manufacturing an integrated antenna according to claim 5, wherein the second antenna element is provided with a first electrode member with a feeding point, and the dummy member is provided with a second electrode member having substantially the same shape and size as those of the first electrode member, the second electrode member having no feeding points.

8. A method of manufacturing an integrated antenna according to claim 5, wherein the mounting of the first antenna element and the dummy member includes mounting the first antenna element and the dummy member on the first and second predetermined positions of the base, respectively, such that orientation of the dummy member mounted on the second predetermined position is substantially the same as that of the second antenna element when the second antenna element is mounted on the second predetermined position.

* * * * *